United States Patent [19]

Poterala

[11] Patent Number: 4,622,247

[45] Date of Patent: Nov. 11, 1986

[54] SEAM COMPENSATING COATING APPARATUS AND METHOD

[76] Inventor: Robert J. Poterala, Rte. 15, Rocky Pointe Way, Greenville, S.C. 29607

[21] Appl. No.: 714,160

[22] Filed: Mar. 20, 1985

[51] Int. Cl.[4] ..... B05D 3/12; B05C 11/02; B05C 3/02

[52] U.S. Cl. ..... 427/356; 118/106; 118/123; 118/413; 427/358

[58] Field of Search ..... 118/106, 123, 413; 427/356, 358

[56] References Cited

U.S. PATENT DOCUMENTS 4,109,034 8/1978 Welch ..... 118/123 X 4,357,373 11/1982 Cooper ..... 427/358

*Primary Examiner*—Michael R. Lusignan

*Attorney, Agent, or Firm*—Cort Flint

[57] ABSTRACT

A method and apparatus is disclosed for facilitating passage of a seam (S) on a web (W) traveling underneath the edge of a knife blade (34) on a coating machine (A). The apparatus includes a machine frame (10) and a support surface (32) carried by the frame over which the web (W) travels. The vertical knife blade (34) is carried in a superimposed position adjacently above the support surface for contacting the web traveling between the knife blade and support surface to apply a coating material to the web. A movable blade assembly unit (B) is provided for carrying the knife blade (34) in the vertical disposition and for movement relative to the frame. A blade motion guide mechamism (C, 76, 78, 80, 82 D) is provided for positively guiding the movement of the blade assembly unit (B, 38, 40, 42, 44) on the frame when the blade is moved by the seam (S) in a backward arcuate lifting motion from a blade-down position to a blade-up position facilitating seam passage. A blade motion retarding mechanism (E, 92, 100, 106) is carried by the frame for gradually applying an increasing pressure on the knife blade against the seam during the backwards arcuate motion of the blade.

27 Claims, 7 Drawing Figures

SEAM COMPENSATING COATING APPARATUS AND METHOD

BACKGROUND OF THE INVENTION

The invention relates to apparatus and a method for coating a web traveling through a coating machine wherein passage of a web seam underneath a coating knife blade is facilitated by a floating backward arcuate movement of the knife blade, with increasing pressure against the seam portion to maintain contact. The apparatus may also be advantageously utilized to maintain a constant blade pressure against the fabric in a floating mode.

Fabric is coated in web form traveling through a coating machine where lengths of fabric are joined together by a thickened seam portion whereby a continuous web can be provided traveling through the coating machine. In certain type of coating machines a knife blade is carried over a roller or other supporting surface and the web travels between the blade and support roller. Coating compound is applied to the fabric prior to passing underneath the coating blade. The coating blade then spreads the coating compound into and over the fabric. However, passage of the thickened seam portion underneath the coating blade without damage to the seam or without the application of an irregular or excessive amount of coating is a problem to which considerable attention need be given.

In blade-over-roller coating machines employing a trough feed system, the problem becomes even more severe due to the utilization of a metering gap between an open edge of the trough and the coating blade for feeding the coating compound onto the fabric. This increases the problems of excessive and irregular coating of the fabric at the seam portion. This also renders it more difficult to support the coating knife blade in a movable fashion to avoid damage to the fabric by engagement with the knife blade edge. The knife blade is set closely on the surface of the fabric for spreading the coating compound over and into the fabric. Often the coating knife blade must be held against the fabric with a certain amount of pressure for satisfactory coating. Thus, due to the closeness of the blade against the fabric and the pressure, considerable seam damage can occur.

Heretofore, it has been proposed to provide a pivotal coating blade on a coating machine. The blade is held down by an air cylinder which exerts a slight air pressure on the blade which allows it to pivot upward when hit by the seam. The air pressure is a constant preset value, and does not satisfactorily enable the blade to ride over the seam in contact therewith. Furthermore, the slight air pressure which is needed on the air cylinder to allow it to pivot often does not return the blade after seam passage. Efforts to increase the air pressure to return the blade to its blade down position have made it difficult for the blade to lift when engaged by a seam. Furthermore, the above described system is only usable for very thin blades, such as two or three inches in height which are easily deflectable.

U.S. Pat. Nos. 3,176,651 and 2,534,320 disclose puddle coating machines. In this type of machine a traveling web passes over the surface of a rotating backup roll, and a trailing doctor blade is applied to the web surface. A puddle of coating material is provided between the blade and the traveling web. However, this is a different coating process and apparatus than one which utilizes a vertically disposed coating blade arranged over a coating roller, and a trough feed system for supporting a coating compound above a traveling fabric web. While mechanisms are employed in the aforesaid patents for applying a uniform pressure on the blade against the web, this would not facilitate passage of a thickened seam portion of the web in a suitable manner.

Accordingly, an important object of the present invention is to provide an apparatus and method which compensates for the passage of a thickened seam portion on a web traveling through a coating machine.

Still another important object of the present invention is to provide an apparatus and method for accommodating the passage of a thickened seam portion underneath a coating blade on a blade-over-roller coating machine employing a trough feed system.

Still another important object of the present invention is to provide a method and apparatus for compensating for seam passage on a coating machine wherein a coating blade is positively guided in a floating backward arcuate motion to facilitate passage of a thickened seam portion.

Still another important object of the present invention is to provide a method and apparatus for a coating machine which accommodates the passage of a thickened seam portion underneath a coating blade wherein the coating blade is counterbalanced against the web with an increasing force so that the blade does not bounce out of contact when impacted initially by the seam, but is caused to ride over and maintain contact with the seam.

Still another important object of the present invention is to provide an apparatus and method for mounting a blade assembly unit on a coating machine which includes a trough feed system and a coating blade which are set a predetermined distance apart to create a metering gap wherein the entire assembly moves in a backward arcuate motion upon impact with a seam portion of a web traveling beneath the trough and blade.

Still another important object of the present invention is to provide a movable blade assembly unit on a coating machine which guides a coating blade in a floating backward arcuate motion upon engagement with a seam having a greater horizontal component than vertical component to reduce the initial inertial impact forces.

Still another important object of the present invention is to provide an apparatus and method for biasing and guiding a movable coating blade against a web so that a thickened seam of the web moves the coating blade a greater distance horizontally than vertically on initial impact, and then lifts the blade over the seam whereby seam damage is prevented and even coating of the seam is achieved.

SUMMARY OF THE INVENTION

The above objectives are accomplished according to the present invention by providing a blade assembly unit which includes a coating knife blade for contacting the traveling web. A support surface is carried by the frame underneath the knife blade over which the traveling web passes through the coating machine. The web passes between the knife blade and the support surface. A blade assembly lifting mechanism is carried by the frame for carrying and guiding the knife blade on the frame in a backward arcuate blade lifting motion in the direction of web travel upon contact with the seam. The knife blade is caused to move in an arcuate blade-lifting motion having a horizontal component and a vertical component of movement. Upon engaging the thickened seam, the knife blade is guided by the blade assembly lifting means to move a greater distance horizontally than vertically reducing the inertial impact force from the seam impact. The knife blade is then guided to move vertically and horizontally in a lifting movement to facilitate seam passage without seam damage, and with even coating of the seam. A blade motion retarding mechanism is connected to blade assembly lifting mechanism for applying a force which urges the blade against the fabric. The force gradually increases as the blade moves in the backward arcuate motion to maintain blade and seam contact. It is preferred that the ratio of the horizontal and vertical movement of the knife blade at initial seam impact is about 4:1.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DETAILED DESCRIPTION OF A PREFERRED EMBODIMENT

The invention relates to coating machines and more particularly to a coating machine wherein a vertical knife blade is arranegd over a roller or other support surface. A web traveling through the coating machine passes between the web traveling through the coating machine passes between the knife edge and the support surface as a coating compound is applied to the fabric web prior to traveling underneath the knife blade. The knife blade spreads the coating compound into and over the fabric with a uniform penetration and absorption. Depending on the viscosity of the coating compound, a trough feed system for supporting the compound above the fabric and controlling the absorption of the coating compound into the fabric may be provided. Within the trough, laterally adjustable sealing dams are provided which contain the width of the coating compound to that of the fabric passing beneath the trough. If the coating compound is of low viscosity, the trough may not be needed. In this case, two laterally movable end dams are provided to control the width of the coating compound to that of the fabric.

A coating machine generally embodying a blade over roller and trough feed system as described above is manufactured by Mascoe Systems Corporation of Mauldin, S.C. as model 4KC and 2CC.

The trough may be adjustable in its position relative to the coating blade to vary the metering gap between the free edge of the trough and the blade. In this case, longitudinally adjustable sealing dams may be utilized which are the subject matter of applicant's co-pending patent application entitled Adjustable Sealing End Dams for a Coating.

Since the general details of the coating machine, not forming a part of the present invention, are known, only those features of the coating machine as are necessary to an understanding of the invention will be disclosed and described herein.

Figure 1:
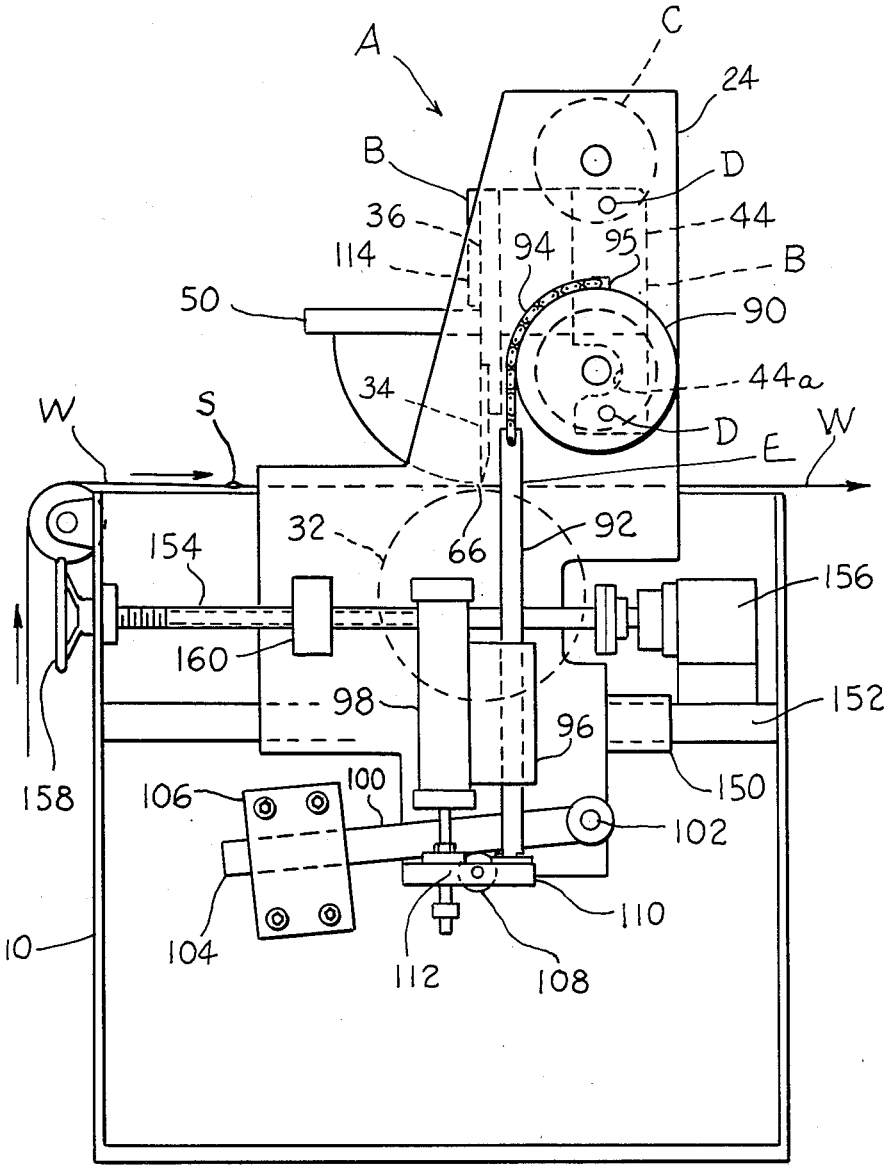
FIG. 1 is an end elevation illustrating and apparatus and method according to the instant invention for accommodating passage of a seam through a coating machine.
Figure 2:
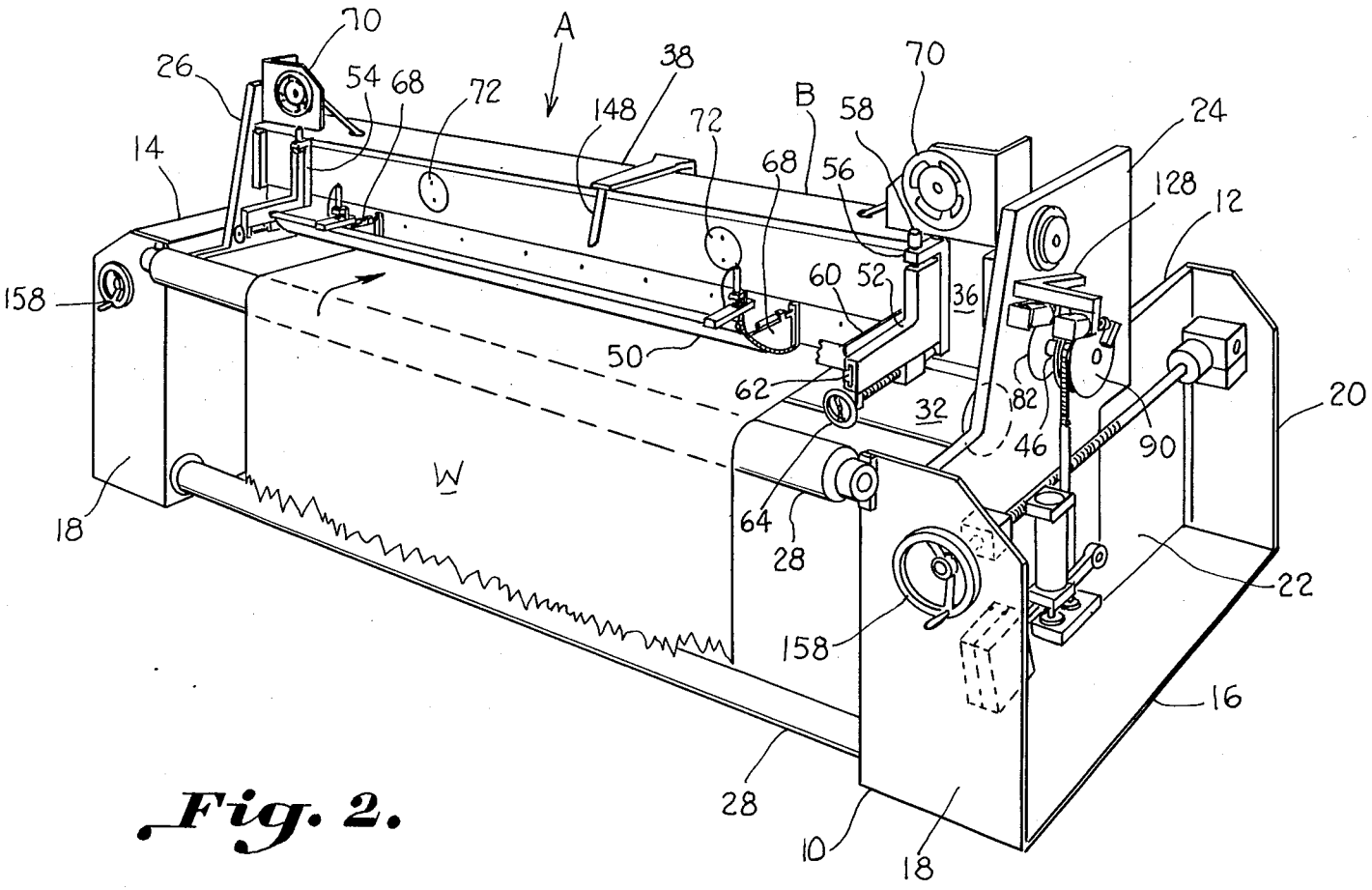
FIG. 2 is a perspective view illustrating an apparatus and method according to the instant invention for compensating for seam passage on a coating machine.

Accordingly, FIGS. 1 and 2 illustrate a coating machine shown generally at A which includes a frame having a pair of side frame base assemblies 12 and 14. Each side frame base assembly includes a bottom plate 16, a pair of front and rear plates 18 and 20, and a back plate 22 which includes a vertically extended side plate 24 on the right side of the machine which is referred to as 26 on the left side of the machine. A guide roller 28 is carried between the side base assemblies 12 and 14 for guiding a web W of fabric through the machine. Similar guide rolls 30 are carried at the rear of the machine. There is a coating support roller 32 carried by the frame.

There is a vertically disposed coating knife blade 34 disposed over the coating roller 32. The coating blade 34 is attached to a blade back 36. The coating blade 34 and blade back 36 are carried by a blade assembly lifting means which includes a movable blade assembly unit B and a blade motion guide means C. The blade assembly lifting means moves and guides the coating blade 34 in a backwards arcuate movement on impact with a seam S formed across the web as will be more fully explained hereinafter.

The movable blade assembly unit B includes a top plate 38 and a parallel bottom plate 40. A pair of integral side plates 42 and 44 are secured to the spaced plates 38 and 40 which span across the coating machine, as can best be seen in FIGS. 2 and 5. There is a notch **44*a* formed in the side plate 44, and a correspondingly shaped notch 42*a* formed in the side plate 42 for fitting around a rotary shaft 46 which extends across the machine between the side frames 24 and 26**.

There is a trough feed system 50 which is also carried by the blade back 36. There are a pair of L-shaped bracket arms 52 and 54 which are attached to the blade back 36 by means of a mounting bracket 56 having a mounting pin 58 which threads into the top of the bracket arm 52 and at 54. There is a vertical bore (not shown) in the vertical arms of each of the L-shaped bracket arms which slideably receives a vertical pin (not shown) carried by the mounting brackets 56. The L-shaped bracket arms 52, 54 are thus guided on the pins and may be adjusted by turning the threaded studs 58.

The trough 50 includes end plates 60 at each end thereof which are attached to the respective L-shaped bracket arms 52 and 54. There is a T-shaped keyway 62 formed in the opposing faces of the arms 52 and 54. A correspondingly shaped key (not shown) is affixed to the end plate 60 is slideably received in the keyway 62. By means of a turn screw 64, the trough position may be adjusted horizontally to vary a metering gap 66 provided between the trough and the coating blade. For this purpose, a pair of longitudinally adjustable sealing dams 68 are carried in the trough 50 which may be constructed in accordance with the teachings of applicant's co-pending application referred to heretofore. Since the details of the adjustable sealing dams are disclosed in the aforesaid application, which disclosure is hereby incorporated herein by reference, the details will be omitted herein.

The ends of the coating blade may be independently adjusted by means of a turn wheel 70 carried at each end of the frame. The turn wheels are in turn connected to circular mounts 72 by way of universal joints (not shown). By this means the ends of the doctor plate may be adjusted independently for adjusting the vertical position of the doctor blade so that it contacts the web as desired.

Figure 5:
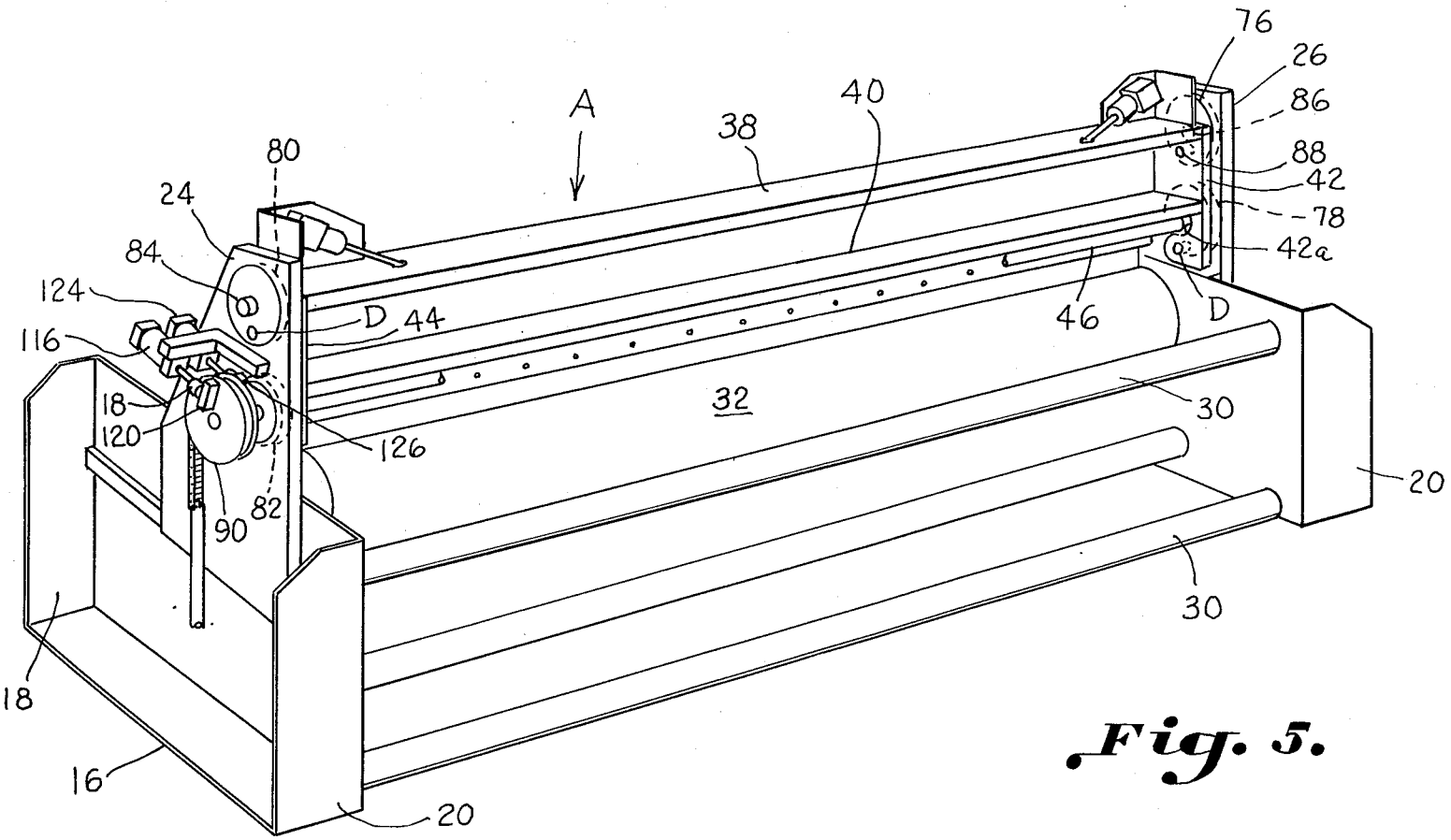
FIG. 5 is a rear perspective view illustrating an apparatus and method according to the present invention for compensating for seam passage on a coating machine.

Referring now to FIGS. 1 and 5, the blade motion guide means C can best be seen as including a plurality of annular hub means 76 and 78 rotatably journaled within the side plate 26. The hub means are spaced one above the other as can best be seen in FIG. 5. There is a rotary hub means provided by a rotary hub 80 and a rotary hub 82 carried in a superimposed position in the side frame 24. The rotary hubs being rotatably journaled therein by any suitable means such as bearings and the like. A rotary shaft means is provided by the rotary shaft 46 extending between the side frames 24 and 26 which is the rotary axis for the rotary hubs 82 and 78. The rotary hubs 80 and 76 and carried on short rotary shafts 84 and 86 respectively. These shafts do not extend across the machine as does the shaft 46.

The blade motion guide means C further includes an eccentric connection at D in all the aforedescribed rotary hubs which is pivotally connected to the side plates 42 and 44 of the movable blade assembly B as can best be seen in FIGS. 1 and 5. The pivot connection D is provided by a short pivot shaft 88 affixed to either the side plate or the rotary hub, and journaled in the other of the members. As can best be seen in FIG. 2, the rotary shaft 46 extends through the side frame 24 and has mounted on the end a pulley wheel 90.

Referring now in more detail to FIG. 1, a blade motion retarding means E is illustrated which is connected to the blade motion guide means C by means of the pulley wheel 90. Pulley wheel 90 is affixed to the shaft 46 which is in turn affixed to the rotary hub 82. The blade motion retarding means E provides a force on the coating blade 34 which increases against the seam as the blade rides over the seam to thus retard the backward arcuate motion of the blade. The blade maintains contact with the seam and does not fly away upon initial seam contact. A gradually increasing biasing force is applied on the blade against the seam during the backward arcuate movement of the blade.

As can best be seen in FIG. 1, the blade motion retarding means E includes a counterbalanced linkage means in the form of a chain 94 connected to the pulley wheel 90 and a straight linkage arm 92. The end of the chain 94 is connected to a block 95 affixed to pulley 90. The linkage arm 92 is slideably received in a sleeve 96 affixed to an air cylinder 98 which is in turn affixed to the machine frame. The linkage means is a variable length linkage. A lever arm 100 has one end pivoted at 102 to the machine frame, and a second end 104 to which there is attached a counterbalancing weight 106. Intermediate the ends 102 and 104, the lever arm 100 and linkage means 92 are interconnected by a movable contact means 108. This movable contact means includes a foot lever 110 carried on the end of the straight linkage 92 having a rotating roller 112 which supports the bottom edge of the lever arm 100 as can best be seen in FIGS. 1, and 3–4. As the lever arm pivots, the roller rolls on the bottom edge of the lever arm to facilitate low-friction contact and delicate balancing of the counterbalance linkage means heretofore described.

Figure 3:
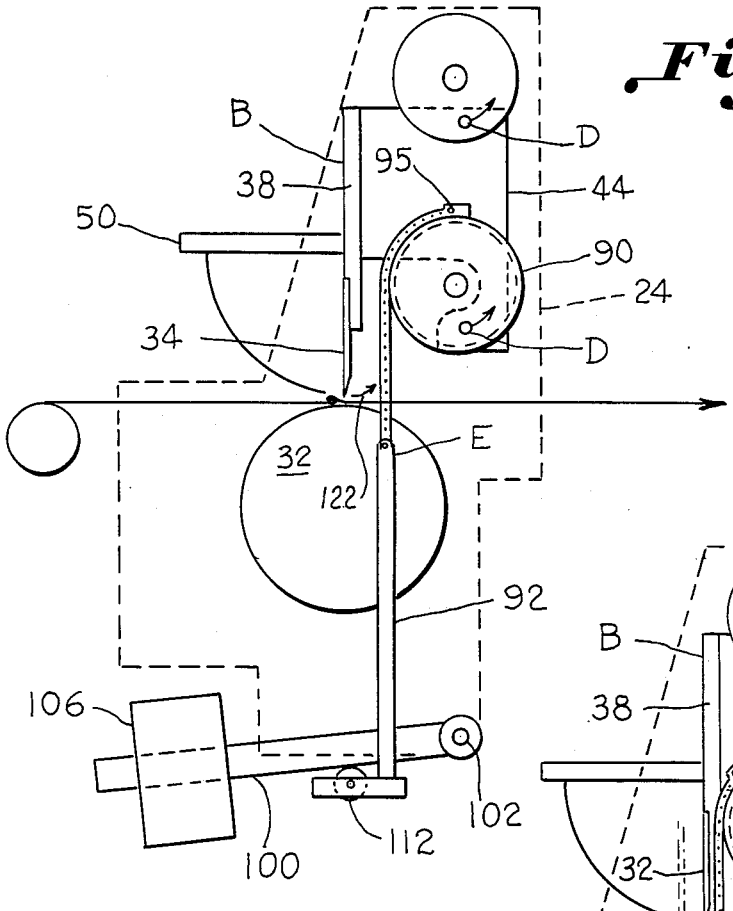
FIG. 3 is a schematic view illustrating an apparatus and method for compensating for seam passage on a coating machine in accordance with the instant invention wherein the coating blade is in a blade down position.

Referring now to the full line arm position of FIG. 1 and FIG. 3, the apparatus of the present invention is illustrated in the blade down position prior to seam passage. In this position, the blade back 36 rests against an abutment block 114. The blade is urged against the abutment block in the blade down position and is locked therein by a blade locking means in the form of an air cylinder 116. The air cylinder 116 includes a piston rod 118 which is urged against a locking block 120 carried in a desired position on the wheel pulley 90, as can best be seen in FIG. 5. With the air cylinder 116 activated, the piston rod 118 is extended and the blade is urged down against the fabric and against the abutment block 114. A desired amount of air pressure may be admitted to the air cylinder to apply a first biasing force which biases the blade against the web for coating. The biasing force of the counterbalanced linkage means E is taken out of play with air cylinders 116 on.

In the full-line position of FIGS. 1 and 3, the counterbalancing linkage means, including the variable linkage 92, the lever arm 100, the counterbalancing weight 106, and the shiftable contact roller 112 is essentially balanced with the downward weight of the blade 34 and blade assembly unit B being slightly larger than the counterbalancing forces whereby the counterbalancing linkage means is maintained in the full line arm position shown.

Figure 4:
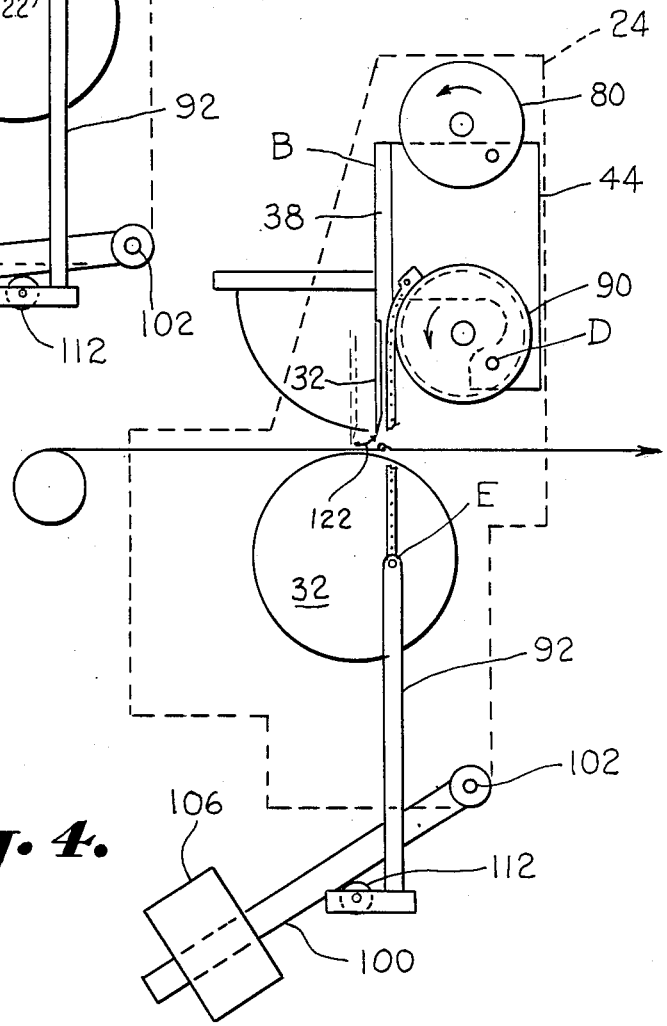
FIG. 4 is a schematic illustration of an apparatus and method according to the present invention for compensating for seam passage on a coating machine wherein the coating blade is in a blade up position.

Referring now to FIG. 4, the coating blade 34 is shown in an exaggerated blade up position which allows passage of the seam. The blade travels from the blade down position of FIG. 3 to the blade up position of FIG. 4 in the backwards arcuate motion shown schematically by the arrow at 122. During this backwards arcuate motion, the blade contacts and rides over the seam under the downward biasing force of the counterbalance linkage means E. For this purpose, the blade locking means 116 may be deactuated whereby the air piston 118 is retracted so that the pulley wheel 90 may rotate counterclockwise. The seam is allowed to move the coating blade backwards and then upwards to facilitate passage. There is a position limiting means in the form of a second air cylinder 124 whose piston rod forms a stop for limiting the maximum upward movement of the blade 34 and blade assembly unit B when actuated. This defines the maximum blade up position. There is an abutment block 126 carried on the back of the pulley wheel 90 in a desired circumferential position to limit the backward arcuate movement. The air cylinders 116 and 124 are carried on the side frame by means of a bracket 128.

Referring to FIGS. 1 and 4, the pivotal point of eccentric connection D on the rotary hubs 76–82 is located somewhere in the range of 0 to 15 degrees counterclockwise from the vertical. Preferably, the eccentric point of connection is at 15 degrees from the vertical. At this point, a backward arcuate motion is effected having a horizontal component which is greater than its vertical component on the ratio of about 4:1. This enables the inertial impact of the seam against the blade to be lessened since the blade has a horizontal component in the backwards direction which is four times greater than the vertical component of its movement. Thereafter, the horizontal component decreases and the vertical component increases so that the lifting movement of the blade as it rides over the seam is imparted by the guide means. The eccentric connection D is illustrated at about a 5:30 clock position in FIG. 1 which is its normal position. Upon arrival of the seam, the connection D moves to the position shown in FIG. 4 whereupon all four of the rotary hubs rotate on their respective rotary axes to guide the blade assembly unit B in the backward arcuate motion.

In operation, the air cylinder 116 is deactuated automatically or manually upon the detection of a seam passing through the coating machine. Thus, the biasing means provided by the air cylinder is released and the second biasing means provided by the counterbalance linkage assembly E takes over. A sufficient downward force of the blade against the web is exerted due to the weight of the blade assembly B at this time. As the seam initially impacts the blade, the blade is caused to move backwards initially at a much faster rate than it moves vertically due to the eccentric pivot connection of D described above. The blade moves backwards almost with the seam and the initial impact. Thereafter, the blade begins to lift as it moves backwards causing the pulley wheel 90 to move counterclockwise causing the variable linkage means E to lengthen. The lever arm 100 thus pivots downwardly or counterclockwise as can be seen in FIG. 4. The lever arm 100 thus loses its mechanical advantage and the downward force on the pully wheel 90 lessens. This makes it gradually more difficult for the seam to push the blade 34 upwards, and an increasing force on the blade against the seam occurs. This causes the blade to maintain contact with the seam and not bounce rapidly away upon first contact. The force of the blade 34 against the seam gradually increases so that the blade rides over the seam and coats it evenly. In this manner, a coating compound is spread over the seam as evenly as it is over the web so that no irregularity or excessive coating is applied. The greater horizontal movement of the blade upon seam impact reduces seam tearing. It will be noted that the movable contact provided by the roller wheel 112 causes the effective lever arm of lever 100 to vary applying a gradually decreasing force on the pulley wheel 90 so that the force of the blade against the seam increases gradually in a generally linear fashion.

Figure 7:
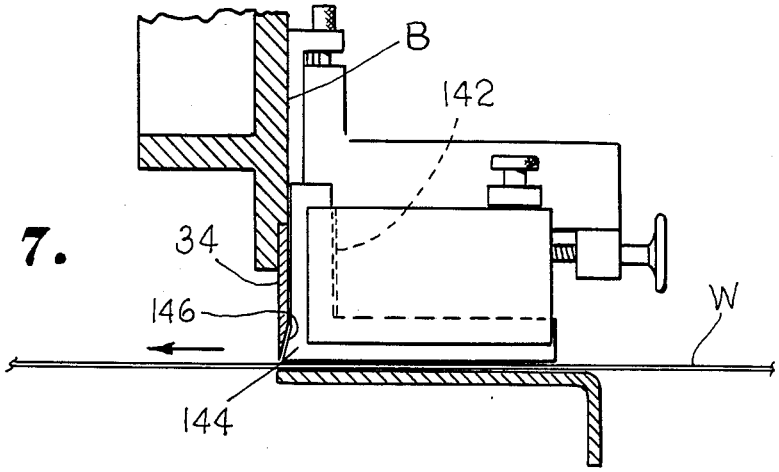
FIG. 7 an elevation illustrating an adjustable dam seal for use with an apparatus and method for compensating for seam passage on a coating machine in accordance with the present invention.
Figure 6:
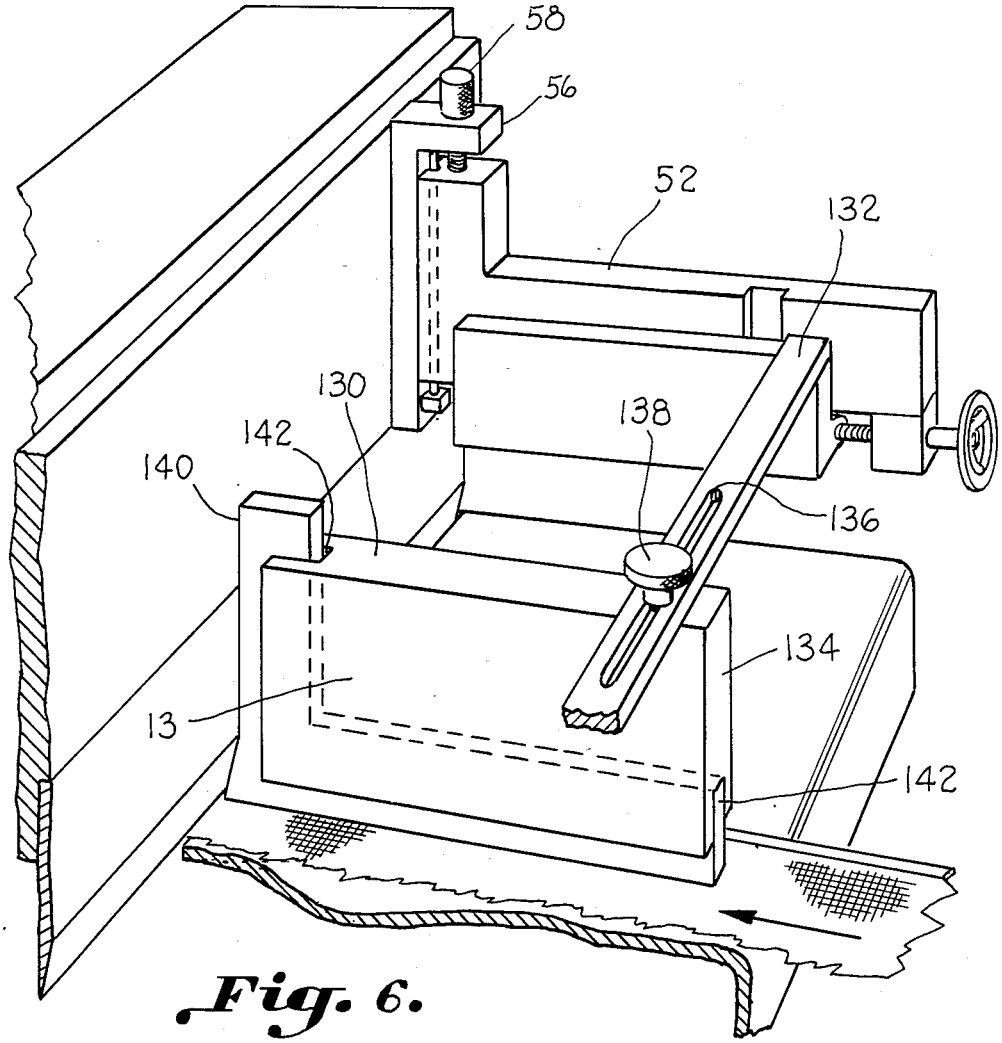
FIG. 6 is a partial perspective view illustrating an adjustable end dam seal for apparatus and method for a coating machine in accordance with the present invention.

Referring now to FIGS. 7 and 6, an adjustable sealing dam is illustrated which may be utilized with the seam compensating apparatus and method of the present invention. In this embodiment, the trough feed system 50 is not employed, such as is the case for a low viscosity coating compound. An adjustable sealing dam 130 is illustrated which is supported on a guide bar 132 affixed between the L-shaped brackets 52 and 54. The adjustable sealing dam 130 may be adjusted laterally by means of a groove 136 formed in the guide bar 132 and a set screw 138 threaded into the block of a stationary dam plate 134. There is a floating Teflon seal plate 140 which is slideably received in a groove 142 formed in the dam plate 134.

As can best be seen in FIG. 7, the floating seal plate 140 has a foot 144 shaped in the same contour as an edge 146 of the coating blade 34. The floating seal plate 140 normally rests on the fabric web W traveling through the coating machine as can best be seen in FIG. 7. The dam plate 134, affixed to bar 132, moves with the blade unit B and coating blade 34 as they move in the arcuate blade motion during seam passage. As the blade lifts, however, the floating seal plate 140 moves vertically downward to ride on the web traveling through the machine. In this manner, a lateral seal is provided of the coating compound (not shown) deposited between the sealing dams by a movable nozzle 148 which transverses the machine frame.

The entire blade assembly unit B may be moved horizontally for adjustment by making side plates 24, 26 movable on the frame bases 12 and 14. A sleeve 150 affixed to each side plate slides on a bar 152 affixed to each frame base. A turnscrew 154 is rotatably journalled in front plate 18 and in a rear journal 156 which may be motorized. Manual operation of turnscrew 154 may be had by wheel 158. The screw 154 is threadably journalled in a threaded block 160 fixed to the side plate 24.

It is also contemplated that the blade assembly unit B may operate in a "floating" mode of operation wherein the knife blade 34 rides on the fabric with a generally uniform pressure against the fabric regardless of changes in fabric tension. This is highly advantageous in some coating applications. For example, the blade assembly unit B may be shifted forwardly to a position where blade 34 is not over roller 32 by turning screws 158. In this position, blade 34 may be adjusted to a position slightly below the level of the fabric W. The blade is then brought back to the level of the fabric as the fabric is tensioned. Lock-down cylinder 116 is switched to a floating mode by utilizing conventional switching (not shown). Air at a reduced pressure (for example, 10 psi instead of a locking pressure of 100 psi) is admitted to cylinder 116 so that the air piston may be overridden as the blade floats up under the tension of the fabric. The blade floats down when the fabric becomes slack.

In this mode of operation, the blade 34 will float up and down depending on changes in the tension of the fabric. The couterbalance weight and linkage assembly E will keep the blade counterbalanced within the small ranges of fabric tension. The desired force is provided by adjusting the downward position of the blade as abutting block 114. Thus the counterbalance means may be advantageously used for other than seam passage.

In accordance with the present invention, a method is thus disclosed for facilitating passage of a thick seam of a web underneath the coating blade of a coating machine which comprises the steps of arranging a coating blade on a coating machine by means of a movable blade assembly unit. The web is passed between the knife blade and a support surface. As the seam contacts the coating blade, the movable blade assembly is guided in a backward arcuate lifing motion which causes the knife blade movement to have a greater horizontal component of movement in the direction of seam travel than a vertical component. The knife blade is moved in a generally backward horizontal direction along with the seam upon initial seam impact. The movable blade assembly is then guided with decreased horizontal movement and increased vertical movement for riding over the seam. In accordance with the method, a blade biasing force is applied to the knife blade against the web which gradually increases as the knife blade moves in the backward arcuate motion to maintain blade and seam contact for even coating of the seam and surrounding fabric without an excess application of coating material.

The method further contemplates utilizing a first biasing force to bias the blade against the web during coating of the web, and releasing the first biasing force prior to seam passage. Next, a gradually increasing blade biasing force is applied to the seam during seam passage in lieu of the first biasing force.

While a preferred embodiment of the invention has been described using specific terms, such description is for illustrative purposes only, and its is to be understood that changes and variations may be made without departing from the spirit or scope of the following claims.

What is claimed is:

1. Apparatus compensating for passage of a thickened seam on a web of fabric passing underneath a knife blade of a coating machine comprising:

a coating machine frame through which said traveling web passes;

a knife blade assembly carried by said frame having a knife blade for contacting said traveling web;

a support surface underneath said knife blade over which said traveling web passes through said coating machine whereby said web passes between said knife blade and said support surface;

a blade assembly lifting means carried by said frame for carrying and guiding said knife blade on said frame in a backwards arcuate blade lifting motion in the direction of said traveling web upon contact by said seam;

said arcuate blade lifting motion having a horizontal component of motion and vertical component of motion whereby upon engaging said thickened seam said knife blade is first caused to move a greater distance horizontally than vertically reducing the inertial impact force from seam impact and then to move vertically and horizontally in a lifting movement to facilitate seam passage without seam damage; and blade motion retarding means connected to said blade assembly lifting means for applying a force urging said blade against said fabric which gradually increases as said blade moves backwardly in said arcuate blade motion to maintain blade and seam contact.

2. The apparatus of claim 1 wherein said horizontal component of said knife blade movement has a ratio of about four to one (4:1) to said vertical component of initial blade movement upon seam impact.

3. The apparatus of claim 1 wherein said blade assembly lifting means includes a blade motion guide means for positively guiding said movement of said knife blade from a blade down position for contacting and coating said web to a blade up position facilitating seam passage.

4. The apparatus of claim 3 including position limiting means for limiting the blade up position of said movement of said knife blade.

5. The apparatus of claim 2 including blade locking means carried by said frame for locking said knife blade against movement in said blade down position.

6. The apparatus of claim 4 including means for deactuating said locking means upon detection of said seam approaching said coating machine.

7. The apparatus of claim 1 wherein said blade assembly lifting means includes rotary shaft means carried by said frame means, rotary hub means rotatably carried by said rotary shaft means, eccentric connecting means for connecting said knife blade assembly to said rotary hub means at an eccentric point of connection so that rotation of said rotary hub means causes said knife blade assembly to move in said arcuate motion, and said blade motion retarding means being operatively connected to said rotary hub means to gradually retard rotation of said hub means and said arcuate blade movement maintaining blade and seam contact during said seam passage.

8. The apparatus of claim 7 wherein said eccentric point of connection is in the range of about zero to fifteen degrees counterclockwise from a vertical line perpendicular to the axis of said rotary hub means.

9. The apparatus of claim 1 wherein said blade assembly lifting means comprises:

parallel rotary shafts carried by opposing sides of said machine frame in superimposed position defining an upper rotary axis and a lower rotary axis;

a rotary hub rotatably carried by each of said rotary axes so that an upper and lower rotary hub is provided adjacent each side of said machine frame;

eccentric connecting means eccentrically connecting said knife blade assembly to said upper and lower rotary hubs adjacent each of said frame side; and said motion retarding means being operatively connected to said rotary hub means to gradually retard rotation of said rotary hub means and said arcuate movement of said knife blade.

10. The apparatus of claim 1 wherein said motion retarding means includes a counterbalanced linkage means connected to said blade assembly lifting means for providing a gradually increasing downward biasing force on said knife blade against said seam as said knife blade is lifted in said backwards arcuate motion.

11. The apparatus of claim 10 comprising:

rotary hub means rotatably carried about a rotary axis on said machine frame;

eccentric connecting means connecting said blade lifting assembly to said rotary hub means at an eccentric point of connection;

said counterbalanced linkage means including a linkage means connected to said rotary hub radially offset from said eccentric connecting means;

a lever means having a first end pivotally carried by said frame;

a counterbalanced weight carried by a second end of said lever means; and movable contact means movably interconnecting said lever means and said linkage means over a range of positions intermediate said first and second ends of said lever means.

12. The apparatus of claim 11 wherein said movable contact means includes a roller carried by said linkage means having a roller contact point engaging said lever means whereby said roller rotates as said lever arm pivots causing said contact point to move reducing friction to facilitate more accurate balancing of said counterbalanced linkage means and biasing of said blade and seam against one another.

13. Apparatus for facilitating passage of a seam on a web traveling underneath the edge of a knife blade on a coating machine comprising:

a machine frame;

a support surface carried by said frame over which said web travels during passage through said coating machine;

a vertical knife blade carried in a superimposed position adjacently above said support surface for contacting said web traveling between said knife blade and support surface to apply a coating material to said web;

a movable blade assembly unit for carrying said knife blade in said vertical disposition and for movement relative to said frame;

blade motion guide means for positively guiding the movement of the blade assembly unit on said frame when said blade is moved by said seam in a backward arcuate lifting motion from a blade-down position for contacting and coating said web to a blade-up position for facilitating passage and coating of said seam; and biasing means for urging said knife blade against said web.

14. The apparatus of claim 13 wherein said biasing means includes a blade motion retarding means carried by said frame gradually applying an increasing pressure on said knife blade against said seam during backwards arcuate motion of said blade.

15. The apparatus of claim 14 wherein said biasing means includes a first blade biasing means for urging said blade against said web with a desired force before and after seam passage, and release means for releasing said blade biasing means prior to seam passage allowing said blade motion retarding means to apply pressure to said blade against said seam.

16. The device of claim 13 wherein said blade motion guide means includes a rotary hub rotatably carried by said machine frame and connecting means for eccentrically and pivotally connecting said blade assembly unit to said rotary hub.

17. The device of claim 16 wherein said biasing means includes a linkage connected to said rotary hub, a lever arm having one end pivotally carried by said frame, a counterbalancing weight carried adjacent a second end thereof, wherein said linkage means and said lever arm are interconnected at a contact intermediate said first and second ends of said lever arm.

18. The apparatus of claim 17 wherein said linkage means has a variable length as connected between said rotary hub and said linkage arm, and a point of said contact between said lever arm and linkage means is variable to thereby provide a decreasing mechanical advantage to said linkage arm as said knife blade lifts whereby a gradually increasing force on said blade against said seam web is provided.

19. The apparatus of claim 13 wherein said blade assembly unit includes:

a blade back plate on which said knife blade is carried across the width of said machine;

a coating trough for containing coating material carried by said blade back having a free edge over which said coating material is applied to said web traveling undreneath said trough; and a metering gap formed between said free edge of said trough and said knife blade for metering said coating material onto said web;

whereby said trough and knife blade are unitary and together moves in said backward arcuate motion.

20. The apparatus of claim 19 further comprising:

said blade motion guide means including a rotary hub means carried by said frame;

side plate means pivotally connected to said rotary hub means at an eccentric point of connection; and said blade assembly unit being carried by said side plate means.

21. A method for accommodating passage of a thickened seam of a web passing through a coating machine underneath a coating knife blade comprising the steps of:

arranging said knife blade on said coating machine by means of a movable blade assembly;

passing said web between said knife blade and a support surface;

guiding said movable blade assembly positively in a backward arcuate lifting motion upon engagement with said seam causing a knife blade movement having a greater horizontal component in the direction of seam travel than a vertical component so that said knife blade and seam move generally together in a backwards horizontal direction upon initial impact and thereafter said blade rides gradually over said seam facilitating seam passage without seam damage; and applying a blade biasing force to said knife blade against said web with a biasing force which gradually increases as said knife blade moves in said backward arcuate motion to maintain blade and seam contact for even coating of said seam and surrounding fabric area without application of excess coating material.

22. The method of claim 21 including the steps of:

applying a first uniform biasing force to bias said blade against said web traveling through said coating machine;

releasing said first biasing force prior to seam passage; and applying said gradually increasing blade biasing force during seam passage in lieu of said first uniform biasing force.

23. The method of claim 21 comprising:

arranging rotary hub means on said coating machine to rotate about a central rotary axis;

pivotally connecting said movable blade assembly to said rotary hub means at an eccentric point of pivotable connection with respect to said rotary axis providing said greater horizontal component of movement; and connecting a linkage means having a counterbalanced weight to said rotary hub means for balancing and biasing said knife blade against said seam.

24. The method of the claim 21 including the steps of balancing said knife blade against said web by means of a counterbalancing lever arm connected to said movable blade assembly having a mechanical advantage which decreases as said knife blade moves in said backward arcuate motion.

25. Apparatus for facilitating passage of a seam on a web traveling underneath the edge of a knife blade on a coating machine comprising:

a machine frame;

a support surface carried by said frame over which said web travels during passage through said coating machine;

a vertical knife blade carried in a superimposed position adjacently above said support surface for contacting said web traveling between said knife blade and support surface to apply a coating material to said web;

a movable blade assembly unit for carrying said knife blade in said vertical disposition and for movement relative to said frame;

blade motion guide means for positively guiding the movement of the blade assembly unit on said frame when said blade is moved by said seam in a backward arcuate lifting motion from a blade-down position for contacting and coating said web to a blade-up position for facilitating passage and coating of said seam;

biasing means for urging said knife blade against said web;

a pair of laterally spaced end dams carried by said coating machine adjacent said coating knife blade for limiting the lateral flow of said coating material;

a first dam plate included in each end dam carried for movement with said knife blade; and a floating seal plate interconnected with said dam plate to contain said coating material laterally; and means connecting said dam plates and floating seal plate for relative movement with one another whereby said floating seal plate rides on said web traveling through said coating machine as said dam plate moves with said knife blade during seam passage.

26. The apparatus of claim 25 wherein said interconnecting means includes a horizontal and vertical edge groove formed in said dam plates, said floating seal plate received in said groove, and said groove being dimensioned so that said seal plate floats and moves horizontally and vertically in said groove.

27. The apparatus of claim 25 wherein said seal plate includes an inclined foot inclined rearwardly in the direction of web travel conforming generally to the shape of a bevel on said knife blade.

* * * * *